US009020171B2

(12) United States Patent
Foeh et al.

(10) Patent No.: US 9,020,171 B2
(45) Date of Patent: Apr. 28, 2015

(54) METHOD FOR CONTROL OF ADAPTATION OF FEEDBACK SUPPRESSION IN A HEARING AID, AND A HEARING AID

(75) Inventors: Helge Pontoppidan Foeh, Stenlose (DK); Peter Magnus Norgaard, Vanlose (DK); Thilo Volker Thiede, København Ø (DK)

(73) Assignee: Widex A/S, Lynge (DK)

( * ) Notice: Subject to any disclaimer, the term of this patent is extended or adjusted under 35 U.S.C. 154(b) by 50 days.

(21) Appl. No.: 13/430,680

(22) Filed: Mar. 26, 2012

(65) Prior Publication Data

US 2012/0195450 A1 Aug. 2, 2012

Related U.S. Application Data

(63) Continuation-in-part of application No. PCT/EP2009/063076, filed on Oct. 8, 2009.

(51) Int. Cl.
*H04R 25/00* (2006.01)

(52) U.S. Cl.
CPC ..... *H04R 25/453* (2013.01); *H04R 2225/41* (2013.01)

(58) Field of Classification Search
USPC ..... 381/318, 317, 83, 93, 71.11, 95–96, 381/71.1; 379/406.08
See application file for complete search history.

(56) References Cited

U.S. PATENT DOCUMENTS

| | | | | |
|---|---|---|---|---|
| 5,668,747 | A * | 9/1997 | Ohashi | 708/322 |
| 6,219,427 | B1 * | 4/2001 | Kates et al. | 381/318 |
| 6,434,247 | B1 | 8/2002 | Kates et al. | |
| 6,810,273 | B1 * | 10/2004 | Mattila et al. | 455/570 |

FOREIGN PATENT DOCUMENTS

| | | | | |
|---|---|---|---|---|
| JP | 2007-513531 | A | 5/2007 | |
| JP | 2009-532924 | A | 9/2009 | |
| WO | 2004/105429 | A1 | 12/2004 | |
| WO | 2005091675 | A1 | 9/2005 | |
| WO | 2005096670 | A1 | 10/2005 | |
| WO | 2007042025 | A1 | 4/2007 | |
| WO | 2007113282 | A1 | 10/2007 | |
| WO | WO 2007113282 | A1 * | 10/2007 | H04R 25/00 |

OTHER PUBLICATIONS

International Search Report for PCT/EP2009/063076 dated Mar. 10, 2010.

Japanese Office Action for Japanese Patent Application No. 2012-531246 dated Apr. 9, 2013 with English translation.

* cited by examiner

*Primary Examiner* — Davetta W Goins
*Assistant Examiner* — Oyesola C Ojo
(74) *Attorney, Agent, or Firm* — Sughrue Mion, PLLC

(57) ABSTRACT

A method for controlling adaptation of a feedback suppression filter in a hearing aid comprises the step of suspending the adaptation of the feedback suppression filter when the level of a hearing aid reference signal is below a predetermined threshold. The invention further provides a hearing aid with a feedback suppression filter and with means for suspending adaptation of the feedback suppression filter.

8 Claims, 3 Drawing Sheets

METHOD FOR CONTROL OF ADAPTATION OF FEEDBACK SUPPRESSION IN A HEARING AID, AND A HEARING AID

RELATED APPLICATIONS

The present application is a continuation-in-part of application No. PCT/EP2009/063076, filed on Oct. 8, 2009, with the European Patent Office and published as WO-A1-2011/042055.

BACKGROUND OF THE INVENTION

1. Field of the Invention

The present invention relates to hearing aids. The invention more particularly relates to hearing aids that rely on adaptive feedback suppression in order to reduce the problems caused by acoustic and mechanical feedback. The invention further relates to a method of suppressing feedback in a hearing aid. More specifically, the invention relates to methods for control of the adaptation of feedback suppression systems in hearing aids.

As used within the context of this disclosure, a hearing aid is a small portable device adapted for providing at the users eardrum a version of the acoustic environment that has been amplified according to the users prescription. The device usually comprises a microphone, an amplifier and a miniature loudspeaker (in the hearing aid parlance referred to as a "receiver") situated in an earpiece placed in the users ear canal. It is well known that the operation may suffer from feedback problems, due to the amplified sound feeding back from the speaker to reach the microphone, where it will be picked up and amplified again. Feedback may be acoustic, i.e. through the air around the earpiece, or mechanical, i.e. through the structure of the earpiece.

Acoustic and mechanical feedback from a receiver to one or more microphones will limit the maximum amplification that can be applied in a hearing aid. Due to the feedback, the amplification in the hearing aid can cause resonances, which shape the spectrum of the output of the hearing aid in undesired ways, and, even worse, it can cause the hearing aid to become unstable, resulting in whistling or howling. The hearing aid usually employs compression to compensate hearing loss; that is, the amplification gain is reduced with increasing sound pressures. Moreover, an automatic gain control is commonly used on the output to limit the output level, thereby avoiding clipping of the signal. In case of instability, these compression effects will eventually make the system marginally stable, thus producing a howl or whistle of nearly constant sound level.

Feedback suppression is often used in hearing aids to compensate the acoustic and mechanical feedback. The acoustic feedback path can change dramatically over time as a consequence of, for example, amount of earwax, the user putting on a hat or holding a telephone to the ear, or the user chewing or yawning. For this reason it is customary to apply an adaptation mechanism on the feedback suppression to account for the time-variations.

An adaptive feedback suppression filter can be implemented in a hearing aid in several different ways. For example, it can employ an IIR filter, an FIR filter, or a combination of the two. It can be composed of a combination of a fixed filter and an adaptive filter. The adaptation mechanism can be implemented in several different ways, for example algorithms based on Least Mean Squares (LMS), Normalized Least Mean Squares (NLMS) or Recursive Least Squares (RLS).

2. The Prior Art

WO-A1-2007113282 discloses an anti-feedback system where the adaptation of the coefficients of the adaptive feedback cancellation filter is halted if it is detected that an external tone is played. The publication also discloses methods and hearing aids adapted to detect if a sudden increase in sound pressure occurs and to temporarily suspend the adaptation of the feedback cancellation filter afterwards.

WO-A1-2007113282 discloses that loud sounds (not necessarily sudden) can also cause a nonlinear behavior in one or more components of the hearing aid. The acoustic feedback path as it is seen from the cancelling filter's perspective embraces microphone(s), receiver and input- and output converters. Saturation or overload in one of these units thus corresponds to a non-linearity in the acoustic feedback path. Assuming a linear filter is used for feedback cancellation (such as an FIR filter), the filter is inadequate for modeling the highly nonlinear saturation function, thus leading to errors in the adaptation. Therefore, according to an embodiment, a detector for recognition of these circumstances is included in the adaptation mechanism, and adaptation of the cancellation filter is temporarily suspended when the non-linearity occurs. The adaptation may, according to a particular embodiment, be suspended for a short while after one occurrence of that kind has been detected.

Generally WO-A1-2007113282 discloses that in order to maintain a specific uncertainty on the filter coefficients, the adaptation speed should be reduced when the gain of the hearing aid is reduced.

U.S. Pat. No. 6,434,247 discloses a feedback cancellation system for a hearing aid that adapts a first filter in the feedback path that models the quickly varying portion of the hearing aid feedback path, and adapts a second filter in the feedback path that is used either as a reference filter for constrained adaptation or to model more slowly varying portions of the feedback path. The second filter is updated only when the hearing aid signals indicate that an accurate estimate of the feedback path can be obtained. Changes in the second filter are then monitored to detect changes in the hearing aid feedback path. The first filter is adaptively updated at least when the condition of the signal indicates that an accurate estimate of physical feedback cannot be made. It may be updated on a continuous or frequent basis. It is further disclosed that in a compression hearing aid, the lower the ambient signal level the higher the gain, resulting in a more favorable level of the feedback relative to that of the ambient signal at the microphone and hence giving better convergence of the adaptive filter and a more accurate feedback path model. Thus the rate of adaptation in a compression hearing aid can be increased at low input signal levels or equivalently for high compression gain values.

One problem with the prior art systems is that the anti-feedback system during unfavorable conditions will attempt to adapt to an input signal that is primarily noise.

Another problem is that the anti-feedback system during unfavorable conditions may adapt so fast that the hearing aid becomes unstable.

It is therefore a feature of the present invention to overcome at least these drawbacks and provide more efficient and stable methods for adaptation of anti-feedback systems in hearing aids while maintaining the sound fidelity of the acoustical sounds. Hereby user comfort for the hearing impaired can be improved.

It is another feature of the present invention to provide a hearing aid comprising an anti-feedback system with improved user comfort and sound fidelity.

SUMMARY OF THE INVENTION

The invention, in a first aspect, provides a method of controlling adaptation of a feedback suppression filter in a hearing aid, comprising the steps of converting an input sound into a microphone output signal; deriving an input signal from the microphone output signal; subtracting a feedback suppression signal from the input signal hereby providing a hearing aid processor input signal; adapting filter coefficients of a feedback suppression filter using the hearing aid processor input signal as control signal; forming a hearing aid processor output signal by applying an amplification gain to the hearing aid processor input signal; filtering the hearing aid processor output signal in the feedback suppression filter to derive the feedback suppression signal; and suspending the adaptation of the feedback suppression filter when the level of a hearing aid reference signal is below a predetermined threshold.

This provides a method of controlling adaptation of a feedback suppression system in a hearing aid that efficiently suppresses feedback and provides an improved user comfort and sound fidelity.

The invention, in a second aspect, provides a method of controlling adaptation of a feedback suppression filter in a hearing aid, comprising the steps of converting, in a first microphone, input sound into a first microphone output signal, and converting, in a second microphone, input sound into a second microphone output signal; adding the first microphone output signal and the second microphone output signal hereby forming a first spatial signal; subtracting the first microphone output signal from the second microphone output signal hereby forming a second spatial signal; subtracting a first feedback suppression signal from the first spatial signal, hereby providing a first processor input signal; subtracting a second feedback suppression signal from the second spatial signal, hereby providing a second processor input signal; adapting filter coefficients of a first feedback suppression filter using as control signal the first processor input signal; adapting filter coefficients of a second feedback suppression filter using as control signal the second processor input signal; processing of the first processor input signal and the second processor input signal to form a hearing aid processor output signal; filtering the hearing aid processor output signal in the first feedback suppression filter to derive the first feedback suppression signal; filtering the hearing aid processor output signal in the second feedback suppression filter to derive the second feedback suppression signal; suspending the adaptation of the first feedback suppression filter when the level of a first hearing aid reference signal is below a first predetermined threshold; and suspending the adaptation of the second feedback suppression filter when the level of a second hearing aid reference signal is below a second predetermined threshold.

This provides a method of controlling adaptation of a feedback suppression system, in an advanced hearing aid comprising two microphones, which efficiently suppresses feedback and provides an improved user comfort and sound fidelity.

The invention, in a third aspect, provides a hearing aid comprising a microphone for converting sound into a microphone output signal; an adaptive feedback suppression filter for adaptively estimating a feedback path and for generating a feedback suppression signal; means for combining the feedback suppression signal with the microphone output signal to form a processor input signal; hearing aid processing means for processing the processor input signal to form a hearing aid processor output signal; an output transducer for converting the hearing aid processor output signal into an acoustic output; means for detecting the level of a hearing aid reference signal and comparing the level of the hearing aid reference signal with a predetermined threshold level; and means for suspending adaptation of the adaptive feedback suppression filter when the hearing aid reference signal level is below the predetermined threshold level.

This provides a hearing aid with at least one microphone, which efficiently suppresses feedback and provides an improved user comfort and sound fidelity.

The invention, in a fourth aspect, provides a hearing aid comprising a first microphone for converting sound into a first microphone output signal; a second microphone for converting sound into a second microphone output signal; first spatial transformation means for adding the first microphone output signal and the second microphone output signal hereby forming a first spatial signal; second spatial transformation means for subtracting the first microphone output signal from the second microphone output signal hereby forming a second spatial signal; means for combining a first feedback suppression signal with the first spatial signal hereby providing a first processor input signal; means for combining a second feedback suppression signal with the second spatial signal hereby providing a second processor input signal; means for processing of the first processor input signal and the second processor input signal to form a hearing aid processor output signal; an output transducer for converting the hearing aid processor output signal into an acoustic output; a first adaptive feedback suppression filter for adaptively deriving the first feedback suppression signal by filtering the hearing aid processor output signal, using as control signal the first processor input signal; a second adaptive feedback suppression filter for adaptively deriving the second feedback suppression signal by filtering the hearing aid processor output signal, using as control signal the second processor input signal; means for suspending adaptation of the first feedback suppression filter when the level of a first hearing aid reference signal is below a first predetermined threshold; and means for suspending adaptation of the second feedback suppression filter when the level of a second hearing aid reference signal is below a second predetermined threshold.

This provides an advanced hearing aid with two microphones and spatial transforming means, which efficiently suppresses feedback and provides an improved user comfort and sound fidelity.

Further advantageous features appear from the dependent claims.

Still other features of the present invention will become apparent to those skilled in the art from the following description wherein the invention will be explained in greater detail.

BRIEF DESCRIPTION OF THE DRAWINGS

By way of example, there is shown and described a preferred embodiment of this invention. As will be realized, the invention is capable of other different embodiments, and its several details are capable of modification in various, obvious aspects all without departing from the invention. Accordingly, the drawings and descriptions will be regarded as illustrative in nature and not as restrictive. In the drawings.

DETAILED DESCRIPTION OF THE INVENTION

One problem with prior art systems is that the adaptation speed of the anti-feedback systems typically increases with decreasing microphone input signal level. This is disadvantageous in some situations because a very low microphone input signal level requires that the microphone input signal level due to acoustical and mechanical feedback is likewise very low, and the anti-feedback system will therefore attempt to adapt to an input signal that may primarily be low signal level noise, such as e.g. microphone noise.

Another problem with prior art systems is that very low microphone input signal levels may lead to instability due to the adaptation speed of the anti-feedback system being too high. This may e.g. be the case for adaptation algorithms based on the NLMS algorithm.

In modern hearing aids it is also known to turn off the microphone under special circumstances. The hearing aid microphone may be turned off when sound is provided to the hearing aid through direct audio input, when the hearing aid is used in a special telecoil program, when the user listens to a sound message from the hearing aid or when a user simply wishes to mute his hearing aid. Obviously the microphone input signal levels will fall to very low values under these circumstances.

Figure 1:
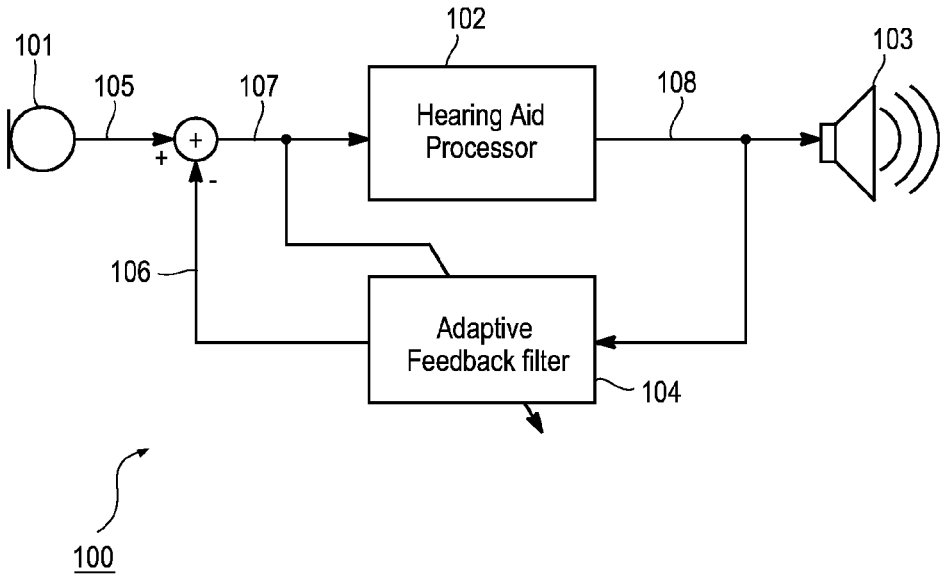
FIG. 1 illustrates highly schematically a hearing aid with a feedback suppression system comprising an adaptive feedback suppression filter.

Reference is first made to FIG. 1, which illustrates highly schematically a hearing aid 100 with an adaptive feedback suppression filter. The hearing aid basically comprises microphone 101, hearing aid processor 102, receiver 103 and adaptive feedback suppression filter 104. In FIG. 1, the level of the input signal 105 is compensated by subtraction of the level of the feedback suppression signal 106. The resulting signal 107 is used as input signal for the hearing aid processor 102 and control signal for the adaptive feedback suppression filter 104. The output signal 108 from the hearing aid processor 102 is used as input signal for the receiver 103 and input signal for the adaptive feedback suppression filter 104.

Figure 2:
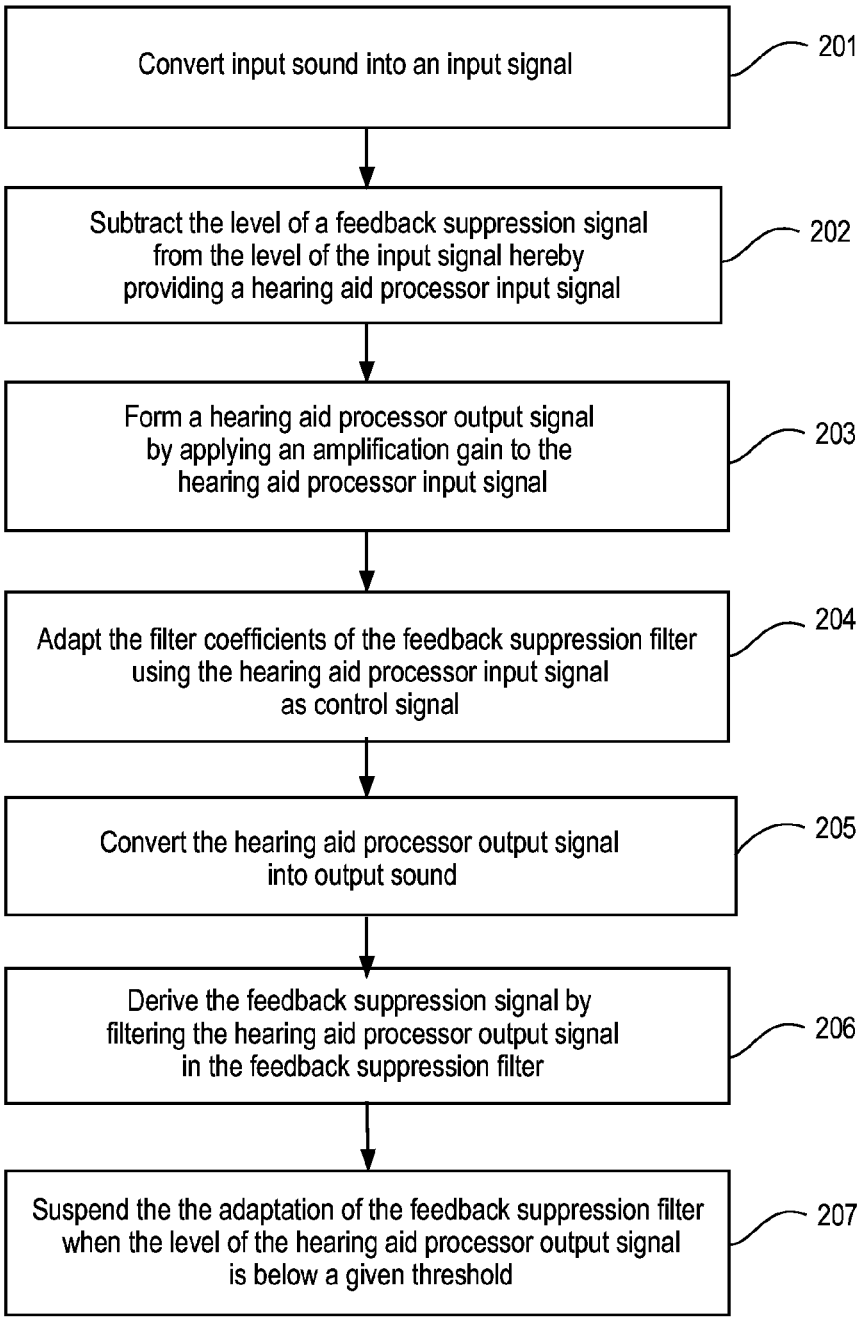
FIG. 2 shows a flow diagram illustrating a method of controlling adaptation of an anti-feedback system in a hearing aid according to a method embodiment of the invention.

Reference is now made to FIG. 2, which illustrates highly schematically a flow diagram of a method of controlling adaptation of a feedback suppression signal in a hearing aid according to a first method embodiment of the invention.

In a first step 201, sound is converted into an input signal by a hearing aid input transducer. In a second step 202, the level of a feedback suppression signal is subtracted from the level of the input signal, hereby forming a hearing aid processor input signal. In a third step 203, the hearing aid processor calculates and applies a gain to the hearing aid processor input signal, hereby forming a hearing aid processor output signal. In a fourth step 204, the adaptive feedback suppression filter adapts its filter coefficients using the hearing aid processor input signal as control signal. In a fifth step 205, the hearing aid processor output signal is converted into output sound by a hearing aid output transducer. In a sixth step 206, the feedback suppression signal is derived from the hearing aid processor output signal by filtering the hearing aid processor output signal in the feedback suppression filter. In a seventh step 207, the adaptation of the feedback suppression filter is suspended when the level of the hearing aid processor output signal is below a first predetermined threshold.

In another embodiment the adaptation of the feedback suppression filter is suspended when the level of the input signal is below a second predetermined threshold.

In yet another embodiment the adaptation of the feedback suppression filter is suspended when a level of a whitened hearing aid processor output signal is below a third predetermined threshold. Whitening for optimizing the adaptive feedback suppression in hearing aids is known per se. This is further described in e.g. WO-A1-2005096670.

The hearing aid input signal, the hearing aid processor output signal and the whitened hearing aid processor output signal may all be denoted reference signal as a general term.

Figure 3:
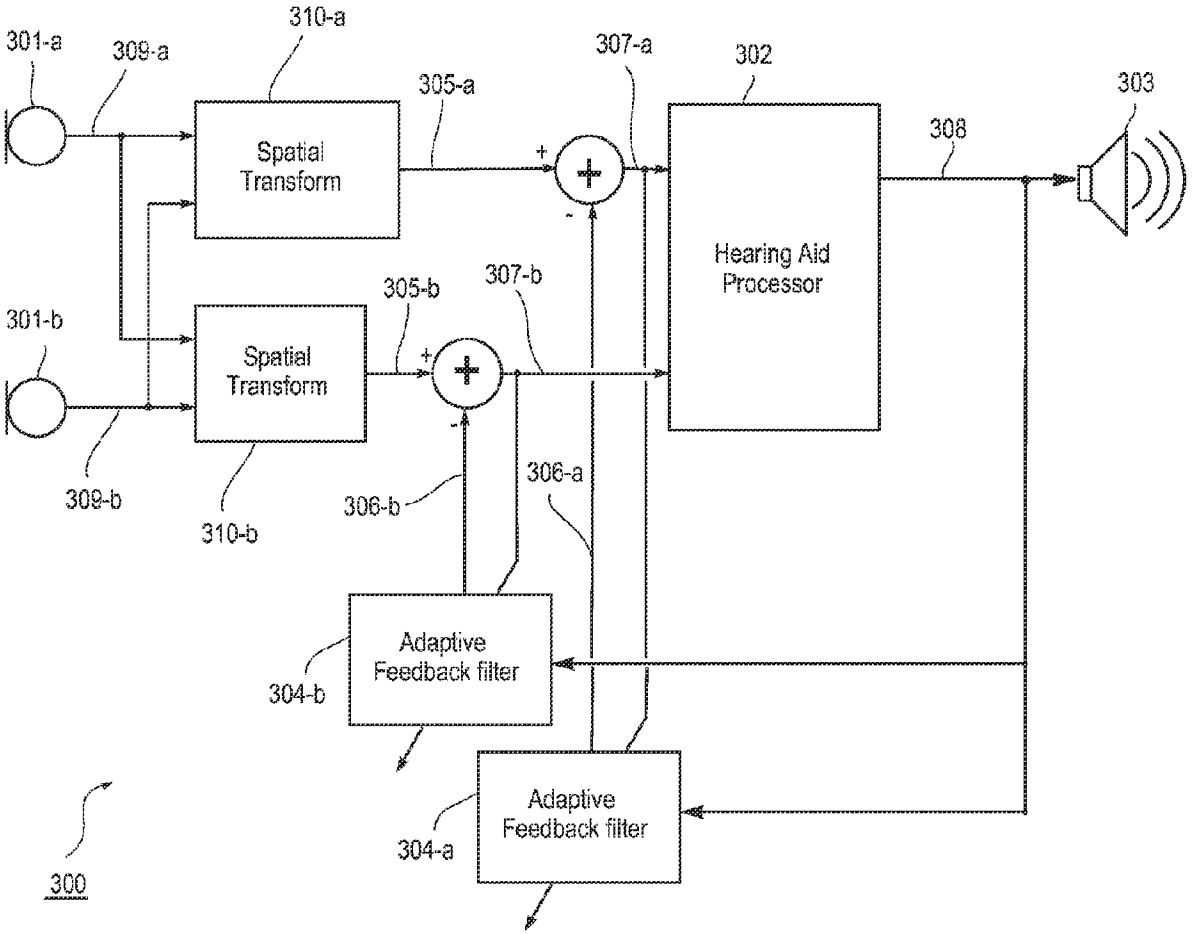
FIG. 3 illustrates highly schematically a hearing aid with an anti-feedback system comprising two adaptive feedback suppression filters according to an apparatus embodiment of the invention.

Reference is now made to FIG. 3, which highly schematically illustrates a hearing aid 300 with an anti-feedback system comprising two adaptive feedback suppression filters. The hearing aid basically comprises a pair of microphones 301-*a* and 301-*b*, a hearing aid processor 302, a receiver 303 and a pair of adaptive feedback suppression filters 304-*a* and 304-*b*. In FIG. 3, a first input signal 305-*a* is formed by using a first microphone 301-*a* for converting input sound into a first microphone output signal 309-*a*, using a second microphone 302-*b* for converting input sound into a second microphone output signal 309-*b*, and adding, in spatial transformation means 310-*a*, said first microphone output signal 309-*a*, and said second microphone output signal 309-*b*, hereby forming said input signal 305-*a*.

Combining the microphone output signals by summing produces a signal that can be denoted an omni-directional input signal or a first spatial signal. A second input signal 305-*b* is formed by using a second microphone 301-*b* for converting input sound into a second microphone output signal 309-*b*, using a first microphone 302-*a* for converting input sound into a first microphone output signal 309-*a*, and subtracting, in spatial transformation means 310-*b*, first microphone output signal 309-*a* from second microphone output signal 309-*b*, hereby forming input signal 305-*b*. Combining the microphone output signals by subtraction produces a signal that can be denoted a bi-directional input signal or a second spatial signal. The levels of the input signals 305-*a* and 305-*b* are compensated by subtraction of the feedback suppression signals 306-*a* and 306-*b*. The resulting signals 307-*a* and 307-*b* are used as input signals for the hearing aid processor 302 and as control signals for the adaptive feedback suppression filters 304-*a* and 304-*b*, respectively. The output signal 308 from the hearing aid processor 302 is used as input signal for the receiver 303 and input signal for the adaptive feedback suppression filters 304-*a* and 304-*b*.

Hearing aids comprising both omni-directional and bi-directional input signals for beam forming are well known in the art. In one such system a first feedback suppression filter provides the feedback suppression signal for the omni-directional input signal, and a second feedback suppression filter provides the feedback suppression signal for the bi-directional input signal. Further information concerning such systems may be found in WO-A1-2007042025.

According to an embodiment the decision to suspend the adaptation of a feedback suppression filter is taken individually for each filter. Hereby it becomes possible to only suspend adaptation of the second feedback suppression filter while the first feedback suppression filter adapts normally. This is especially advantageous in the case where the input sound is primarily impinging perpendicular to the line connecting the two microphones in the hearing aid, because the bi-directional input signal in this case will be approximately nil, independently of the volume of the input sound and the setting of the hearing aid.

Other modifications and variations of the structures and procedures will be evident to those skilled in the art.

We claim:

1. A method of controlling adaptation of a feedback suppression filter in a hearing aid, comprising the steps of:

converting an input sound into a microphone output signal;

deriving an input signal from the microphone output signal;

subtracting a feedback suppression signal from the input signal hereby providing a hearing aid processor input signal;

adapting filter coefficients of a feedback suppression filter using the hearing aid processor input signal as control signal;

forming a hearing aid processor output signal by applying an amplification gain to the hearing aid processor input signal;

filtering the hearing aid processor output signal in the feedback suppression filter to derive the feedback suppression signal; and suspending the adaptation of the feedback suppression filter when the level of a hearing aid reference signal is below a predetermined threshold, thereby indicating there is insufficient sound signal available for adaptation of said feedback suppression filter.

2. The method according to claim 1, wherein the input signal is selected as the hearing aid reference signal.

3. The method according to claim 1, wherein the hearing aid processor output signal is selected as the hearing aid reference signal.

4. The method according to claim 1, wherein a whitened hearing aid processor output signal is selected as the hearing aid reference signal.

5. A method of controlling adaptation of a feedback suppression filter in a hearing aid, comprising the steps of:

converting, in a first microphone, input sound into a first microphone output signal, and converting, in a second microphone, input sound into a second microphone output signal;

adding the first microphone output signal and the second microphone output signal hereby forming a first spatial signal;

subtracting the first microphone output signal from the second microphone output signal hereby forming a second spatial signal;

subtracting a first feedback suppression signal from the first spatial signal, hereby providing a first processor input signal;

subtracting a second feedback suppression signal from the second spatial signal, hereby providing a second processor input signal;

adapting filter coefficients of a first feedback suppression filter using as control signal the first processor input signal;

adapting filter coefficients of a second feedback suppression filter using as control signal the second processor input signal;

processing of the first processor input signal and the second processor input signal to form a hearing aid processor output signal;

filtering the hearing aid processor output signal in the first feedback suppression filter to derive the first feedback suppression signal;

filtering the hearing aid processor output signal in the second feedback suppression filter to derive the second feedback suppression signal;

suspending the adaptation of the first feedback suppression filter when the level of a first hearing aid reference signal is below a first predetermined threshold, thereby indicating there is insufficient sound signal available for adaptation of said first feedback suppression filter; and suspending the adaptation of the second feedback suppression filter when the level of a second hearing aid reference signal is below a second predetermined threshold, thereby indicating there is insufficient sound signal available for adaptation of said second feedback suppression filter.

6. The method according to claim 5, wherein the first spatial signal is selected as the first hearing aid reference signal and the second spatial signal is selected as the second hearing aid reference signal.

7. A hearing aid comprising:

a microphone for converting sound into a microphone output signal;

an adaptive feedback suppression filter for adaptively estimating a feedback path and for generating a feedback suppression signal;

means for combining the feedback suppression signal with the microphone output signal to form a processor input signal;

hearing aid processing means for processing the processor input signal to form a hearing aid processor output signal;

an output transducer for converting the hearing aid processor output signal into an acoustic output;

means for detecting the level of a hearing aid reference signal and comparing the level of the hearing aid reference signal with a predetermined threshold level indicating there is sufficient sound signal available for adaptation; and means for suspending adaptation of the adaptive feedback suppression filter when the hearing aid reference signal level is below the predetermined threshold level.

8. A hearing aid comprising:

a first microphone for converting sound into a first microphone output signal;

a second microphone for converting sound into a second microphone output signal;

first spatial transformation means for adding the first microphone output signal and the second microphone output signal hereby forming a first spatial signal;

second spatial transformation means for subtracting the first microphone output signal from the second microphone output signal hereby forming a second spatial signal;

means for combining a first feedback suppression signal with the first spatial signal hereby providing a first processor input signal;

means for combining a second feedback suppression signal with the second spatial signal hereby providing a second processor input signal;

means for processing of the first processor input signal and the second processor input signal to form a hearing aid processor output signal;

an output transducer for converting the hearing aid processor output signal into an acoustic output;

a first adaptive feedback suppression filter for adaptively deriving the first feedback suppression signal by filtering the hearing aid processor output signal, using as control signal the first processor input signal;

a second adaptive feedback suppression filter for adaptively deriving the second feedback suppression signal by filtering the hearing aid processor output signal, using as control signal the second processor input signal;

means for suspending adaptation of the first feedback suppression filter when the level of a first hearing aid reference signal is below a first predetermined threshold, thereby indicating there is insufficient sound signal available for adaptation of said first feedback suppression filter; and means for suspending adaptation of the second feedback suppression filter when the level of a second hearing aid reference signal is below a second predetermined threshold, thereby indicating there is insufficient sound signal available for adaptation of said second feedback suppression filter.

* * * * *